US009784259B2

(12) United States Patent
Yamamoto et al.

(10) Patent No.: US 9,784,259 B2
(45) Date of Patent: Oct. 10, 2017

(54) VARIABLE DISPLACEMENT SWASH PLATE TYPE COMPRESSOR

(71) Applicant: KABUSHIKI KAISHA TOYOTA JIDOSHOKKI, Aichi-ken (JP)

(72) Inventors: Shinya Yamamoto, Kariya (JP); Hiroyuki Nakaima, Kariya (JP); Kengo Sakakibara, Kariya (JP); Yusuke Yamazaki, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 225 days.

(21) Appl. No.: 14/656,100

(22) Filed: Mar. 12, 2015

(65) Prior Publication Data

US 2015/0267692 A1 Sep. 24, 2015

(30) Foreign Application Priority Data

Mar. 24, 2014 (JP) ..... 2014-059599

(51) Int. Cl.
*F04B 27/18* (2006.01)
*F04B 27/10* (2006.01)
*F04B 1/14* (2006.01)

(52) U.S. Cl.
CPC ..... *F04B 27/1804* (2013.01); *F04B 1/146* (2013.01); *F04B 27/1072* (2013.01); *F04B 2027/1822* (2013.01); *F04B 2027/1827* (2013.01); *F04B 2027/1895* (2013.01)

(58) Field of Classification Search
CPC ..... F04B 27/1054–27/1072; F04B 2027/1895; F04B 2027/1822–2027/1831; F04B 2027/1804; F04B 2027/1809–2027/1818; F04B 1/146
USPC ..... 417/222.1, 222.2, 218, 269, 270
See application file for complete search history.

(56) References Cited

U.S. PATENT DOCUMENTS 4,037,993 A * 7/1977 Roberts ..... F04B 27/1804 417/222.2
4,174,191 A 11/1979 Roberts
5,259,736 A 11/1993 Terauchi
6,957,604 B1 * 10/2005 Tiedemann ..... F04B 1/295 417/222.1

FOREIGN PATENT DOCUMENTS

JP 52-131204 11/1977
JP 04-191472 7/1992
JP 08-105384 4/1996

OTHER PUBLICATIONS

Search Report issued by E.P.O. patent office in E.P.O. Patent Application No. 15156858.1, dated Aug. 11, 2015.

* cited by examiner

*Primary Examiner* — Alexander Comley
(74) *Attorney, Agent, or Firm* — Greenblum & Bernstein, P.L.C.

(57) ABSTRACT

In a compressor of the present invention, a first acting portion and a second acting portion are formed at a rear end of a first cylinder portion of a movable body. The first and the second acting portions are formed by stepping across a top dead center surface, and are plane-symmetrical with respect to the top dead center surface. Further, an affected portion is formed on a front surface of a swash plate. The first and the second acting portions and the affected portion are located eccentrically to a top dead center position corresponding portion side from a drive shaft axis.

5 Claims, 5 Drawing Sheets

VARIABLE DISPLACEMENT SWASH PLATE TYPE COMPRESSOR

TECHNICAL FIELD

The present invention relates to a variable displacement swash plate type compressor.

BACKGROUND ART

Japanese Patent Laid-Open No. 52-131204 discloses a conventional variable displacement swash plate type compressor (hereinafter, described as a compressor). In the compressor, suction chambers, discharge chambers, a swash plate chamber, and a plurality of cylinder bores are formed in a housing. In the housing, a drive shaft is rotatably supported. In the swash plate chamber, a swash plate that is rotatable by rotation of the drive shaft is provided. Between the drive shaft and the swash plate, a link mechanism is provided. The link mechanism allows change of an inclination angle of the swash plate. Here, the inclination angle refers to an angle of the swash plate to the direction orthogonal to a drive shaft axis of the drive shaft. In the respective cylinder bores, pistons are accommodated reciprocally. A conversion mechanism is constructed to cause the respective pistons to reciprocate in the cylinder bores at a stroke corresponding to the inclination angle by rotation of the swash plate. Further, an actuator changes the inclination angle. A control mechanism controls the actuator. The control mechanism has a pressure regulating valve.

The link mechanism has a lug member, a hinge ball and a link. The lug member is fixed to the drive shaft in the swash plate chamber. The hinge ball is disposed in a center of the swash plate with the drive shaft being inserted therethrough. The hinge ball and the actuator are engaged with each other at the drive shaft axis side, that is, the center of the swash plate. The link is provided between the lug member and the swash plate. The swash plate is pivotably connected to the lug member via the link.

The actuator has a lug member, a movable body, and a control pressure chamber. The movable body is inserted through the drive shaft, and moves in a drive shaft axis direction to be able to change the inclination angle. The control pressure chamber is defined by the lug member and the movable body, and moves the movable body by an internal pressure.

In the compressor, the control mechanism allows the discharge chamber and the control pressure chamber to communicate with each other by the pressure regulating valve, and thereby the pressure in the control pressure chamber is increased. Thereby, the movable body moves in the drive shaft axis direction to press the hinge ball. Therefore, in the compressor, the swash plate pivots on the hinge ball in a direction to decrease the inclination angle. In this manner, in the compressor, a discharge capacity per one rotation of the drive shaft can be decreased.

However, in the above described conventional compressor, the hinge ball and the actuator are engaged with each other in the center of the swash plate. Therefore, in the compressor, a stroke in the drive shaft axis direction of the movable body at the time of the actuator pressing the hinge ball becomes large. Therefore, in the compressor, the length of shaft cannot help making long in order to secure the stroke.

Thus, it is conceivable to define in the swash plate a top dead center corresponding portion as a portion corresponding to atop dead center of the respective pistons and a bottom dead center corresponding portion as a portion corresponding to a bottom dead center of the respective pistons, and to cause the actuator and the swash plate to engage with each other in a position eccentric to the top dead center corresponding portion side in the swash plate from the center of the swash plate, in the compressor. In this case, the stroke in the drive shaft axis direction of the movable body can be made smaller than in the case in which the actuator and the swash plate are engaged with each other in the center of the swash plate. Thereby, reduction in the shaft of the compressor can be realized.

However, a compression reaction force acts on the rotating swash plate at a posterior side in a rotating direction from the top dead center corresponding portion. Therefore, when the actuator presses the swash plate simply in the position eccentric to the top dead center corresponding portion side, a moment that inclines the swash plate in a direction with a line connecting the top dead center corresponding portion and the bottom dead center corresponding portion as a center of rotation acts on the swash plate. Therefore, hollowing occurs to the swash plate, and on changing the inclination angle, the actuator is difficult to move in the drive shaft axis direction. Therefore, in the compressor in this case, the inclination angle is difficult to change, and controllability is reduced.

The present invention is made in the light of the above described conventional circumstances, and an object of the invention is to provide a variable displacement swash plate type compressor capable of exhibiting high controllability while realizing downsizing in a compressor that changes a discharge capacity by using an actuator.

SUMMARY OF THE INVENTION

A variable displacement swash plate type compressor of the present invention comprises a housing in which a suction chamber, a discharge chamber, a swash plate chamber and a cylinder bore are formed, a drive shaft that is rotatably supported by the housing, a swash plate rotatable in the swash plate chamber by rotation of the drive shaft, a link mechanism that is provided between the drive shaft and the swash plate, and allows change of an inclination angle of the swash plate to a direction orthogonal to a drive shaft axis of the drive shaft, a piston that is accommodated in the cylinder bore to be capable of reciprocating, a conversion mechanism that causes the piston to reciprocate in the cylinder bore at a stroke corresponding to the inclination angle by rotation of the swash plate, an actuator capable of changing the inclination angle, and a control mechanism that controls the actuator, wherein the suction chamber and the swash plate chamber communicate with each other, the link mechanism has a lug member that is fixed to the drive shaft in the swash plate chamber, and faces the swash plate, and a swash plate arm in which rotation of the drive shaft is transmitted to the swash plate from the lug member, the actuator has the lug member, a movable body that is disposed between the lug member and the swash plate to engage with the swash plate to be integrally rotatable, and moves in a direction of the drive shaft axis to be able to change the inclination angle, and a control pressure chamber that is defined by the lug member and the movable body, and moves the movable body by an internal pressure, on the movable body, a first acting portion and a second acting portion that engage with the swash plate are formed, on the swash plate, an affected portion that engages with the first acting portion and the second acting portion is formed, in the swash plate, a top dead center corresponding portion is defined as a portion corresponding to a top dead center of the piston, the first acting portion, the second acting portion and the affected portion are located eccentrically to the top dead center corresponding portion side in the swash plate from the drive shaft axis, and the first acting portion and the second acting portion are paired by stepping across a top dead center surface that is formed by the top dead center corresponding portion and the drive shaft axis.

Other aspects and advantages of the present invention will be apparent from the embodiments disclosed in the following description and the attached drawings, the illustrations exemplified in the drawings, and the concept of the invention disclosed in the entire description and drawings.

DETAILED DESCRIPTION OF EXEMPLARY EMBODIMENTS

Hereinafter, Embodiments embodying the present invention will be described with reference to the drawings. Compressors in Embodiments are variable displacement single head swash plate type compressors. This compressor is mounted on vehicles, and configures refrigeration circuits of vehicle air-conditioning apparatuses.

Figure 1:
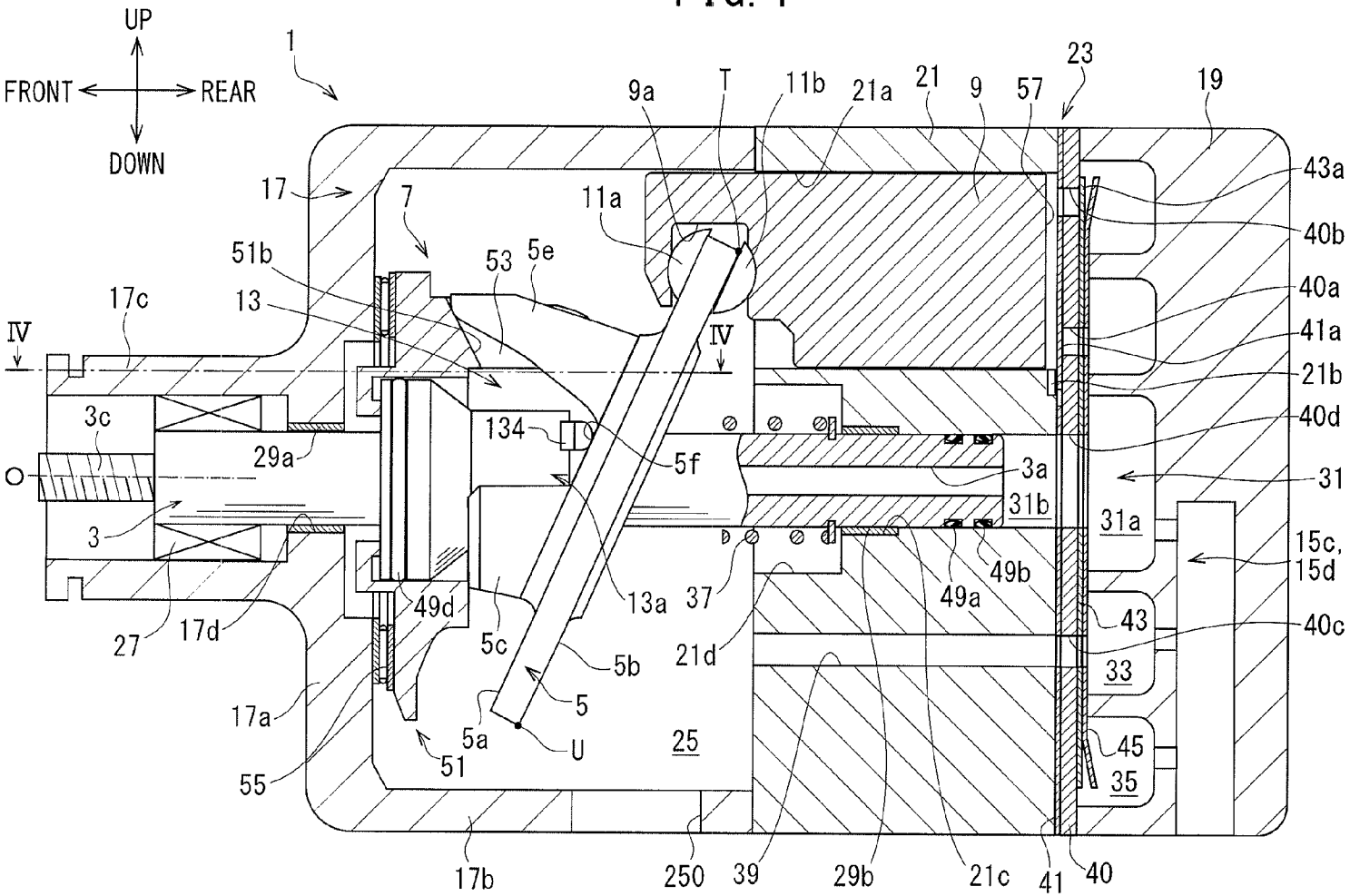
FIG. 1 is a sectional view at a time of a maximum capacity in a compressor of Embodiment 1.
Figure 2:
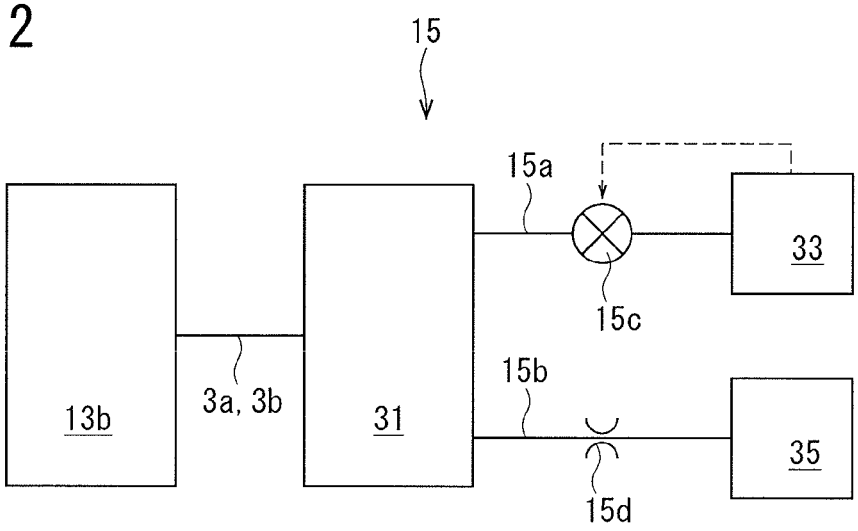
FIG. 2 is a schematic diagram showing a control mechanism, according to the compressor of Embodiment 1.

As shown in FIG. 1, a compressor of Embodiments includes a housing 1, a drive shaft 3, a swash plate 5, a link mechanism 7, pistons 9, a pair of shoes 11*a* and 11*b*, an actuator 13, and a control mechanism 15 shown in FIG. 2.

As shown in FIG. 1, the housing 1 has a front housing 17 that is located at a front part of the compressor, a rear housing 19 that is located at a rear part of the compressor, a cylinder block 21 that is located between the front housing 17 and the rear housing 19, and a valve formation plate 23.

The front housing 17 has a front wall 17*a* that extends in an up and down direction of the compressor in the front part, and a circumferential wall 17*b* that is integrated with the front wall 17*a* and extends toward the rear part from the front part of the compressor. By the front wall 17*a* and the circumferential wall 17*b*, the front housing 17 forms a substantially cylindrical shape with a bottom. Further, by the front wall 17*a* and the circumferential wall 17*b*, a swash plate chamber 25 is formed in the front housing 17.

In the front wall 17*a*, a boss 17*c* that protrudes front is formed. In the boss 17*c*, a shaft seal device 27 is provided. Further, in the boss 17*c*, a first shaft hole 17*d* that extends in a longitudinal direction of the compressor is formed. In the first shaft hole 17*d*, a first sliding bearing 29*a* is provided.

In the circumferential wall 17*b*, an inlet port 250 that communicates with the swash plate chamber 25 is formed. Through the inlet port 250, the swash plate chamber 25 is connected to an evaporator not illustrated. As a refrigerating gas with a low pressure that passes through the evaporator flows into the swash plate chamber 25 through the inlet port 250, a pressure in the swash plate chamber 25 is lower than a pressure in a discharge chamber 35 that will be described later.

In the rear housing 19, a part of the control mechanism 15 is provided. Further, in the rear housing 19, a first pressure regulation chamber 31*a*, a suction chamber 33 and a discharge chamber 35 are formed. The first pressure regulation chamber 31*a* is located in a center portion of the rear housing 19. The discharge chamber 35 is located annularly at an outer circumferential side of the rear housing 19. Further, the suction chamber 33 is formed annularly between the first pressure regulation chamber 31*a* and the discharge chamber 35, in the rear housing 19. The discharge chamber 35 is connected to an outlet port not illustrated.

In the cylinder block 21, cylinder bores 21*a* the number of which is the same as the number of the pistons 9 are formed in a circumferential direction at equiangular intervals. Front end sides of the respective cylinder bores 21*a* communicate with the swash plate chamber 25. Further, in the cylinder block 21, a retainer groove 21*b* that regulates a maximum angle of a suction reed valve 41*a* that will be described later is formed.

Furthermore, in the cylinder block 21, a second shaft hole 21*c* that extends in the longitudinal direction of the compressor while communicating with the swash plate chamber 25 is provided to penetrate the cylinder block 21. In the second shaft hole 21*c*, a second sliding bearing 29*b* is provided. Note that in place of the first sliding bearing 29*a* and the second sliding bearing 29*b* described above, rolling bearings can be adopted respectively.

Further, in the cylinder block 21, a spring chamber 21*d* is formed. The spring chamber 21*d* is located between the swash plate chamber 25 and the second shaft hole 21*c*. In the spring chamber 21*d*, a return spring 37 is disposed. The return spring 37 urges the swash plate 5 the inclination angle of which is minimum toward a front part of the swash plate chamber 25. Further, in the cylinder block 21, a suction passage 39 that communicates with the swash plate chamber 25 is formed.

The valve formation plate 23 is provided between the rear housing 19 and the cylinder block 21. The valve formation plate 23 consists of a valve plate 40, a suction valve plate 41, a discharge valve plate 43 and a retainer plate 45.

In the valve plate 40, the discharge valve plate 43 and the retainer plate 45, suction ports 40*a* the number of which is the same as the number of the cylinder bores 21*a* are formed. Further, in the valve plate 40 and the suction valve plate 41, discharge ports 40*b* the number of which is the same as the number of the cylinder bores 21*a* are formed. The respective cylinder bores 21*a* communicate with the suction chamber 33 through the respective suction ports 40*a*, and communicate with the discharge chamber 35 through the respective discharge ports 40*b*. Further, in the valve plate 40, the suction valve plate 41, the discharge valve plate 43 and the retainer plate 45, a first communication hole 40*c* and a second communication hole 40*d* are formed. By the first communication hole 40*c*, the suction chamber 33 and the suction passage 39 communicate with each other. Thereby, the swash plate chamber 25 and the suction chamber 33 communicate with each other.

The suction valve plate 41 is provided on a front surface of the valve plate 40. At the suction valve plate 41, a plurality of suction reed valves 41*a* capable of opening and closing the respective suction ports 40*a* by elastic deformation are formed. Further, the discharge valve plate 43 is provided on a rear surface of the valve plate 40. At the discharge valve plate 43, a plurality of discharge reed valves 43*a* capable of opening and closing the respective discharge ports 40*b* by elastic deformation are formed. The retainer plate 45 is provided on a rear surface of the discharge valve plate 43. The retainer plate 45 restricts a maximum opening degree of the discharge reed valve 43*a*.

The drive shaft 3 is inserted toward a rear side of the housing 1 from a boss 17*c* side. A front end side of the drive shaft 3 is inserted through the shaft seal device 27 in the boss 17*c*, and supported by the first sliding bearing 29*a* in the first shaft hole 17*d*. Further, a rear end side of the drive shaft 3 is supported by the second sliding bearing 29*b* in the second shaft hole 21*c*. In this manner, the drive shaft 3 is supported rotatably around a drive shaft axis O with respect to the housing 1. In the second shaft hole 21*c*, a second pressure regulation chamber 31*b* is defined in a space from a rear end of the drive shaft 3. The second pressure regulation chamber 31*b* communicates with the first pressure regulation chamber 31*a* through the second communication hole 40*d*. By these first and the second pressure regulation chambers 31*a* and 31*b*, a pressure regulation chamber 31 is formed.

At the rear end of the drive shaft 3, O-rings 49*a* and 49*d* are provided. Thereby, the respective O-rings 49*a* and 49*b* are located between the drive shaft 3 and the second shaft hole 21*c* to seal a space between the swash plate chamber 25 and the pressure regulation chamber 31.

Further, the link mechanism 7, the swash plate 5 and the actuator 13 are fitted to the drive shaft 3. The link mechanism 7 consists of a lug plate 51, a pair of lug arms 53 that are formed at the lug plate 51, and a pair of swash plate arm 5*e* that is formed at the swash plate 5. The lug plate 51 corresponds to a lug member in the present invention. Note that in FIG. 1, with respect to the lug arms 53 and the swash plate arms 5*e*, only one of the lug arms 53 and one of the swash plate arms 5*e* are illustrated. The same also applies to FIG. 6.

The lug plate 51 is formed into a substantially annular ring shape. The lug plate 51 is press-fitted into the drive shaft 3, and is rotatable integrally with the drive shaft 3. The lug plate 51 is located at a front end side in the swash plate chamber 25, is disposed front of the swash plate 5 and faces the swash plate 5. Further, between the lug plate 51 and the front wall 17*a*, a thrust bearing 55 is provided.

Figure 3:
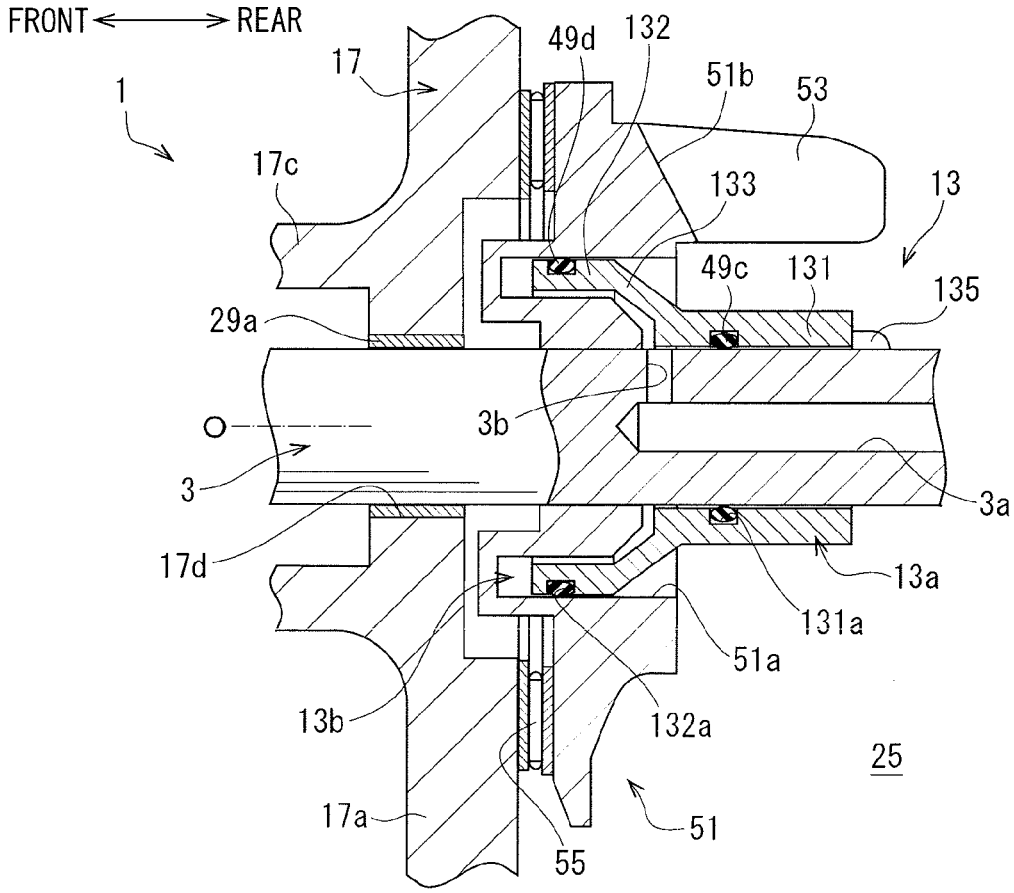
FIG. 3 is an essential part enlarged sectional view showing an actuator, according to the compressor of the embodiment.

As shown in FIG. 3, in the lug plate 51, a cylindrical cylinder chamber 51*a* that extends in a longitudinal direction of the lug plate 51 is concavely provided. The cylinder chamber 51*a* extends to a spot to be an inner side of the thrust bearing 55 in the lug plate 51, from the rear end surface of the lug plate 51.

The respective lug arms 53 extend rearward from the lug plate 51. Further, on the lug plate 51, a guide surface 51*b* is formed at a position between the respective lug arms 53. Though not illustrated, a pair of guide surfaces 51*b* are formed respectively to correspond to the respective lug arms 53. The guide surfaces 51*b* are formed with a downward inclination to a rear end side from a front end side of the lug plate 51.

Figure 4:
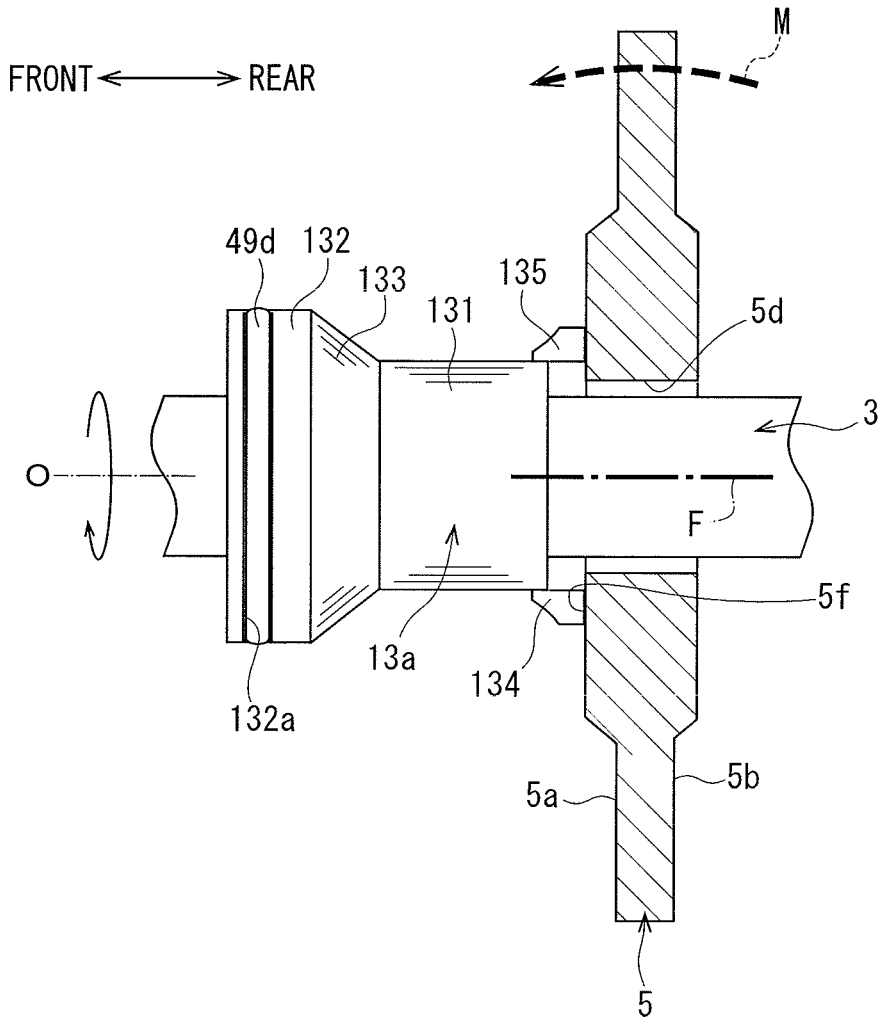
FIG. 4 is an essential part enlarged sectional arrow view from a IV-IV direction in FIG. 1, according to the compressor of the embodiment.

As shown in FIG. 1, the swash plate 5 forms an annular flat plate shape, and has a front surface 5*a* and a rear surface 5*b*. On the front surface 5*a*, a weight portion Sc that protrudes front of the swash plate 5 is formed. The weight portion 5*c* abuts on the lug plate 51 when the inclination angle of the swash plate 5 becomes maximum. Further, as shown in FIG. 4, an insertion hole 5*d* is formed in the swash plate 5. The drive shaft 3 is inserted through the insertion hole 5*d*. Note that in order to facilitate explanation, illustration of the respective swash plate arms 5*e*, the weight portion 5*c*, and the like is omitted in FIG. 4.

Further, on the front surface 5*a*, an affected portion 5*f* is formed. The affected portion 5*f* is formed to be flat. As shown in FIG. 1, in the swash plate 5, a top dead center corresponding portion T is defined as a portion corresponding to a top dead center of the respective pistons 9. The affected portion 5*f* is located eccentrically to the top dead center corresponding portion T side in the swash plate 5 from the drive shaft axis O, in the front surface 5*a*.

As shown in FIG. 1, the respective swash plate arms 5*e* are formed on the front surface 5*a*. The respective swash plate arms 5*e* extend front from the front surface 5*a*.

In the compressor, the respective swash plate arms 5*e* are inserted between the respective lug arms 53, whereby the lug plate 51 and the swash plate 5 are connected. Thereby, rotation of the drive shaft 3 is transmitted to the respective swash plate arms 5*e* from the respective lug arms 53, and the swash plate 5 is rotatable with the lug plate 51, in the swash plate chamber 25. As above, the lug plate 51 and the swash plate 5 are connected, whereby in the respective swash plate arms 5*e*, respective tip end sides abut on the guide surfaces 51*b*. Subsequently, the respective swash plate arms 5*e* slide on the guide surfaces 51*b*, whereby the swash plate 5 is pivotable around a pivoting axis M shown in FIG. 5B while substantially keeping a position at the top dead center corresponding portion T side, with respect to an inclination angle of its own relative to a direction orthogonal to the drive shaft axis O. Details of the pivoting axis M will be described later. In this manner, the swash plate 5 can change to a minimum inclination angle shown in FIG. 6 from a maximum inclination angle shown in FIG. 1.

The actuator 13 consists of the lug plate 51, a movable body 13*a* and a control pressure chamber 13*b*.

As shown in FIG. 1, the movable body 13*a* is inserted through the drive shaft 3, and is movable in a longitudinal direction inside the swash plate chamber 25 in the drive shaft axis O direction while sliding in contact with the drive shaft 3. As shown in FIG. 3, the movable body 13*a* forms a cylindrical shape coaxial with the drive shaft 3. The movable body 13*a* has a first cylinder portion 131, a second cylinder portion 132 and a connection portion 133. The first cylinder portion 131 is located at a rear part of the movable body 13*a*, namely, a side near to the swash plate 5, and is slidable in contact with the drive shaft 3 on an inner circumferential surface. On the inner circumferential surface of the first cylinder portion 131, a ring groove 131*a* is formed, and an O-ring 49*c* is provided in the ring groove 131*a*. The second cylinder portion 132 is located at a front part of the movable body 13*a*. The second cylinder portion 132 is formed to have a larger diameter than the first movable body 131. On an outer circumferential surface of the second cylinder portion 132, a ring groove 132*a* is formed, and an O-ring 49*d* is provided in the ring groove 132*a*. The connection portion 133 is located between the first cylinder portion 131 and the second cylinder portion 132, and extends while gradually enlarging a diameter toward the front part from a rear part of the movable body 13*a*. In the connection portion 133, a rear end continues to the first cylinder portion 131, and a front end continues to the second cylinder portion 132.

Figure 5A:
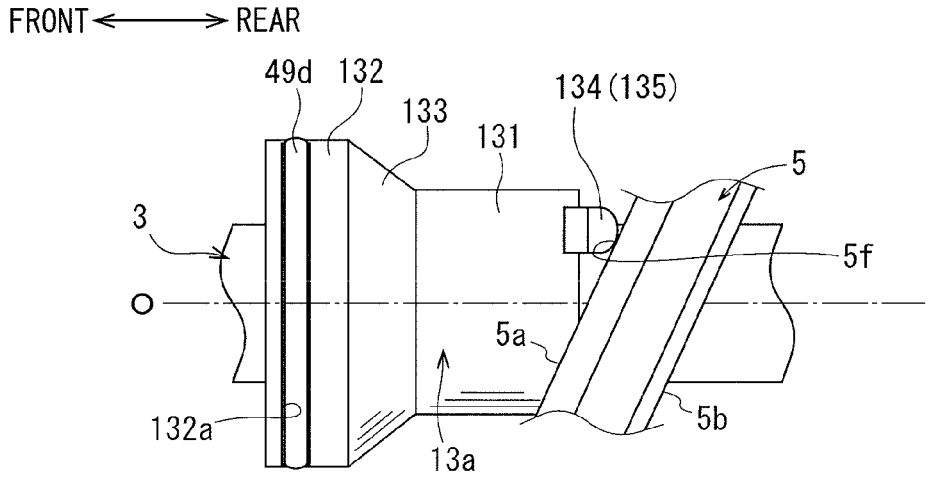
FIG. 5A is an enlarged side view showing the movable body and the like, according to the compressor of the embodiment.
Figure 5B:
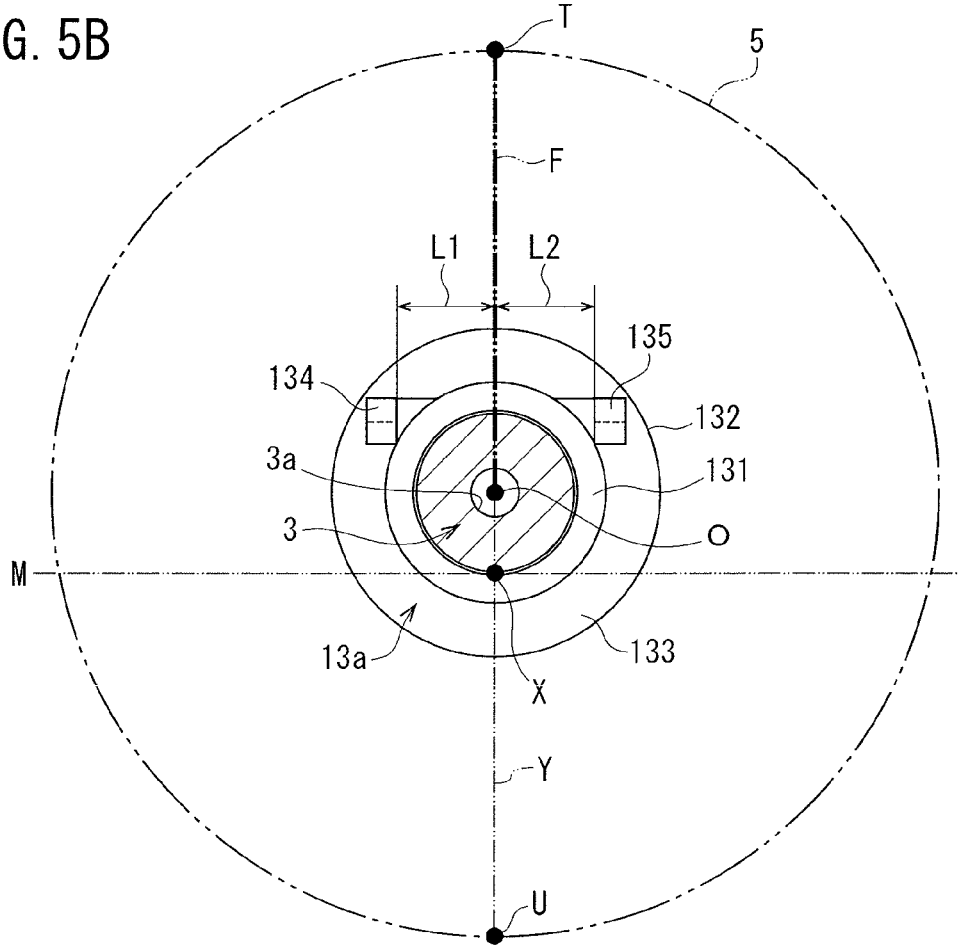
FIG. 5B is an enlarged front view from a rear part showing the movable body and the like, according to the compressor of the embodiment.

Further, as shown in FIG. 5B, at a rear end of the first cylinder portion 131, a first acting portion 134 and a second acting portion 135 are formed. As shown in FIG. 5A, the first and the second acting portions 134 and 135 extend toward the rear part of the movable body 13*a* from an outer circumferential surface of the first cylinder portion 131.

Further, the first and the second acting portions 134 and 135 are formed on the first cylinder portion 131 in such a manner as to step across a top dead center surface F that is formed by the top dead center corresponding portion T of the swash plate 5 and the drive shaft axis O, as shown in FIG. 5B. The movable body 13*a* has the drive shaft 3 inserted therethrough, whereby the drive shaft 3 is located between the first acting portion 134 and the second acting portion 135.

Furthermore, the first acting portion 134 and the second acting portion 135 are formed to be plane-symmetrical with respect to the top dead center surface F. Thereby, a distance L1 from the first acting portion 134 to the top dead center surface F, and a distance L2 from the second acting portion 135 to the top dead center surface F have equal lengths. Further, the first acting portion 134 and the second acting portion 135 are formed on the first cylinder portion 131 so that heights from the drive shaft axis O are equal.

As above, in the movable body 13*a*, the first acting portion 134 and the second acting portion 135 are both provided to be located inside the second cylinder portion 132. In more detail, the first acting portion 134 and the second acting portion 135 are provided at positions that are outside from the first cylinder portion 131 and are inside the second cylinder portion 132.

Further, the first acting portion 134 and the second acting portion 135 are located to be eccentric to the top dead center corresponding portion T side from the drive shaft axis O.

As shown in FIG. 5A, rear ends of the first and the second acting portions 134 and 135 are formed into cylindrical shapes that protrude toward the swash plate 5 side. More specifically, the rear ends of the first and the second acting portions 134 and 135 are formed into cylindrical shapes having generating lines parallel with the pivoting axis M. The pivoting axis M includes a pivoting point X that is located on an intersection line of the outer circumferential surface of the drive shaft 3 and the top dead center surface F, and extends in a direction orthogonal to the drive shaft axis O.

Thereby, as shown by the broken line in FIG. 5B, the first and the second acting portions 134 and 135 are respectively in linear contact with the affected surface 5*f* of the swash plate 5 in parallel with the pivoting axis M. That is to say, the first and the second acting portions 134 and 135 and the affected surface 5*f* are in linear contact with one another in positions eccentric to the top dead center corresponding portion T side from the drive shaft axis O (see FIG. 5A). The first and the second acting portions 134 and 135 are in linear contact with the affected surface 5*f* like this, whereby the movable body 13*a* is rotatable integrally with the lug plate 51 and the swash plate 5.

As shown in FIG. 3, the cylinder chamber 51*a* can accommodate the second cylinder portion 132 and the connection portion 133 by causing the second cylinder portion 132 and the connection portion 133 to advance to an inside.

The control pressure chamber 13*b* is formed among the second cylinder portion 132, the connection portion 133, the cylinder chamber 51*a* and the drive shaft 3. A space between the control pressure chamber 13*b* and the swash plate chamber 25 is sealed by the O-rings 49*c* and 49*d*.

In the drive shaft 3, an axial path 3*a* that extends in the drive shaft axis O direction toward the front end from the rear end of the drive shaft 3, and a radial path 3*b* that extends in a radial direction from a front end of the axial path 3*a* and opens to the outer circumferential surface of the drive shaft 3 are formed. As shown in FIG. 1, a rear end of the axial path 3*a* opens to the pressure regulation chamber 31. Meanwhile, as shown in FIG. 3, the radial path 3*b* opens to the control pressure chamber 13*b*. By the axial path 3*a* and the radial path 3*b*, the pressure regulation chamber 31 and the control pressure chamber 13*b* communicate with each other.

As shown in FIG. 1, a screw portion 3*c* is formed on a tip end of the drive shaft 3. The drive shaft 3 is connected to a pulley or an electromagnetic clutch not illustrated, through the screw portion 3*c*.

The respective pistons 9 are respectively accommodated in the respective cylinder bores 21*a*, and are capable of reciprocating in the respective cylinder bores 21*a*. By the respective pistons 9 and the valve formation plate 23, compression chambers 57 are defined in the respective cylinder bores 21*a*.

Further, in the respective pistons 9, engaging portions 9*a* are concavely provided respectively. In the engaging portion 9*a*, the semispherical shoes 11*a* and 11*b* are respectively provided. The respective shoes 11*a* and 11*b* convert rotation of the swash plate 5 into reciprocal movement of the respective pistons 9. The respective shoes 11*a* and 11*b* correspond to a conversion mechanism in the present invention. In this manner, the respective pistons 9 can reciprocate in the cylinder bores 21*a* respectively at a stroke corresponding to the inclination angle of the swash plate 5.

As shown in FIG. 2, the control mechanism 15 is configured by a low-pressure passage 15*a*, a high-pressure passage 15*b*, a control valve 15*c*, an orifice 15*d*, the axial path 3*a* and the radial path 3*b*.

The low-pressure passage 15*a* is connected to the pressure regulation chamber 31 and the suction chamber 33. Thereby, by the low-pressure passage 15*a*, the axial path 3*a* and the radial path 3*b*, the control pressure chamber 13*b*, the pressure regulation chamber 31 and the suction chamber 33 are brought into a state communicating to one another. The high-pressure passage 15*b* is connected to the pressure regulation chamber 31 and the discharge chamber 35. By the high-pressure passage 15*b*, the axial path 3*a* and the radial path 3*b*, the control pressure chamber 13*b*, the pressure regulation chamber 31 and the discharge chamber 35 communicate with one another.

The control valve 15*c* is provided in the low-pressure passage 15*a*. The low-pressure control valve 15*c* can regulate an opening degree of the low-pressure passage 15*a* based on a pressure in the suction chamber 33. Further, the orifice 15*d* is provided in the high-pressure passage 15*b*.

In the compressor, piping connecting to the evaporator is connected to the inlet port 250 shown in FIG. 1, and piping connecting to a condenser is connected to the outlet port. The condenser is connected to the evaporator via piping and an expansion valve. By the compressor, the evaporator, the expansion valve, the condenser and the like, a refrigeration circuit of an air-conditioning apparatus for a vehicle is configured. Note that illustration of the evaporator, the expansion valve, the condenser and the respective pipings are omitted.

In the compressor which is configured as above, the drive shaft 3 rotates, whereby the swash plate 5 rotates, and the respective pistons 9 reciprocate in the respective cylinder bores 21*a*. Therefore, the compression chamber 57 changes a capacity in response to a piston stroke. Therefore, the refrigerating gas which is sucked into the swash plate chamber 25 by the inlet port 250 from the evaporator passes through the suction chamber 33 from the suction passage 39 and is compressed in the compression chamber 57. Subsequently, the refrigerating gas which is compressed in the compression chamber 57 is discharged into the discharge chamber 35 and is discharged into the condenser from the outlet port.

In the compressor, the inclination angle of the swash plate 5 is changed to increase or decrease the stroke of the respective pistons 9 by an actuator 13, and thereby discharge capacity can be changed.

More specifically, when the control valve 15*c* shown in FIG. 2 makes the opening degree of the low-pressure passage 15*a* large, in the control mechanism 15, the pressure in the pressure regulation chamber 31, and by extension, the pressure in the control pressure chamber 13*b* becomes substantially equal to the pressure in the suction chamber 33. Therefore, by the piston compression force which acts on the swash plate 5, the movable body 13*a* moves toward the lug plate 51 side from the swash plate 5 side in the drive shaft axis O direction, as shown in FIG. 3. Subsequently, a front end side of the movable body 13*a* advances into the cylinder chamber 51*a*.

Further, at the same time, in the compressor, by the piston compression force and the urging force of the return spring 37 which act on the swash plate 5 itself, the swash plate arm Se slides on the sliding surface 51*b* respectively so as to be away from the drive shaft axis O.

Therefore, as shown in FIG. 1, in the swash plate 5, a bottom dead center corresponding portion U is defined as a portion corresponding to a bottom dead center of the respective pistons 9. The bottom dead center corresponding portion U side in the swash plate 5 pivots in a clockwise direction around the pivoting axis M while the position of the top dead center corresponding portion T is substantially kept in the swash plate 5. In this manner, in the compressor, the inclination angle of the swash plate 5 to the drive shaft axis O of the drive shaft 3 increases. Thereby, in the compressor, the stroke of the respective pistons 9 increases, and the discharge capacity per one rotation of the drive shaft 3 becomes large. Note that the inclination angle of the swash plate 5 shown in FIG. 1 is a maximum inclination angle in the compressor.

Figure 6:
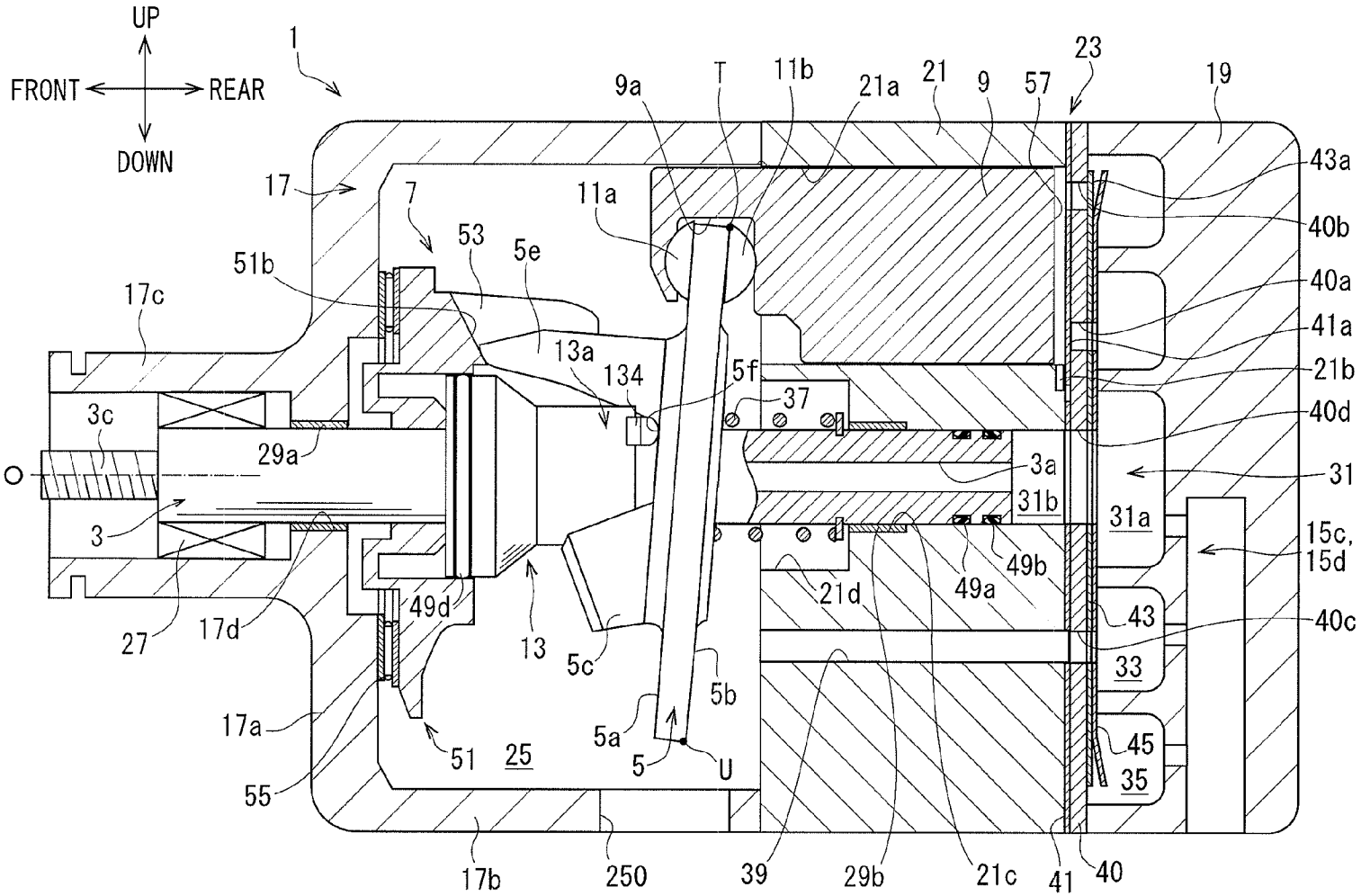
FIG. 6 is a sectional view at a time of a minimum capacity in the compressor of the embodiment.

Meanwhile, when the control valve 15*c* shown in FIG. 2 makes the opening degree of the low-pressure passage 15*a* small, the pressure in the pressure regulation chamber 31 becomes high, and the pressure in the control pressure chamber 13*b* becomes high. Therefore, as shown in FIG. 6, the movable body 13*a* moves in the drive shaft axis O direction toward the swash plate 5 side while moving away from the lug plate 51.

Thereby, as shown in FIG. 4, the first acting portion 134 and the second acting portion 135 respectively press the swash plate 5 toward the rear part of the swash plate chamber 25, in the compressor. Therefore, as shown in FIG. 6, the respective swash plate arms 5*e* respectively slide on the respective sliding surfaces 51*b* so as to be close to the drive shaft axis O.

Therefore, in the swash plate 5, the bottom dead center corresponding portion U side pivots in a counterclockwise direction around the pivoting axis M while the swash plate 5 substantially keeps the position of the top dead center corresponding portion T. In this manner, in the compressor, the inclination angle of the swash plate 5 relative to the drive shaft axis O of the drive shaft 3 is decreased. Thereby, in the compressor, the stroke of the respective pistons 9 decreases, and the discharge capacity per one rotation of the drive shaft 3 becomes small. Further, the swash plate 5 abuts on the return spring 37 by the inclination angle decreasing. Note that the inclination angle of the swash plate 5 shown in FIG. 6 is the minimum inclination angle in the compressor.

As above, in the compressor, the first acting portion 134, the second acting portion 135 and the affected portion 5*f* are in linear contact in the position eccentric to the top dead center corresponding portion T side of the front surface 5*a* of the swash plate 5 from the drive shaft axis O. Thereby, in the compressor, in the position eccentric to the top dead center corresponding portion T side of the front surface 5*a* of the swash plate 5, the first acting portion 134 and the second acting portion 135 press the affected portion 5*f*, whereby the inclination angle of the swash plate 5 can be decreased. Therefore, in the compressor, the stroke in the drive shaft direction O of the movable body 13*a* can be made small at a time of changing the inclination angle of the swash plate 5.

Further, as shown in FIG. 4, in the compressor, a compression reaction force acts on the swash plate 5 at the posterior side in the rotation direction from the top dead center corresponding portion T, when the compressor is operated as described above. Thus, for example, when the movable body 13*a* presses the guided surface 5*f* at one spot in the position eccentric to the top dead center corresponding portion T side, in the compressor, a moment M (see the broken line arrow in FIG. 4) that inclines the swash plate 5 in a direction with a line Y (see FIG. 5B) that connects the top dead center corresponding portion T and the bottom dead center corresponding portion U as a center of rotation acts on the swash plate 5.

In this regard, as shown in FIG. 5B, the first acting portion 134 and the second acting portion 135 are paired in such a manner as to step across the top dead center surface F in the compressor. Therefore, in the compressor, at the time of decreasing the inclination angle, the first acting portion 134 and the second acting portion 135 separately press the affected portion 5*f* with the top dead center surface F as the reference. Thereby, in the compressor, the inclination of the swash plate 5 with the line Y connecting the top dead center corresponding portion T and the bottom dead center corresponding portion U as the center of rotation can be supported by the first acting portion 134 and the second acting portion 135.

Here, in the compressor, the first acting portion 134 and the second acting portion 135 are formed on the first cylinder portion 131 to be plane-symmetrical with respect to the top dead center surface F. Therefore, in the compressor, the first acting portion 134 and the second acting portion 135 can support the inclination of the swash plate 5 in the positions which are equal distance from the top dead center surface F.

Therefore, in the compressor, even when the first acting portion 134 and the second acting portion 135 press the affected portion 5*f* in the position eccentric to the top dead center corresponding portion T side of the swash plate 5, the moment M as described above hardly acts on the swash plate 5. Therefore, in the compressor, the movable body 13*a* easily moves favorably in the drive shaft axis O direction toward the swash plate 5 side while moving away from the lug plate 51, on decreasing the inclination angle. Thereby, in the compressor, the inclination angle is easily changed.

Consequently, the compressor of the embodiment exhibits high controllability while realizing downsizing, in the compressor which changes the discharge capacity by using the actuator 13.

In particular, in the compressor, the drive shaft 3 is located between the first acting portion 134 and the second acting portion 135 as described above. More specifically, the first acting portion 134 and the second acting portion 135 are provided in the positions which are outside from the first cylinder portion 131, and inside of the second cylinder portion 132. Thereby, in the compressor, the space between the first acting portion 134 and the second acting portion 135 can be made as large as possible while increase in size of the movable body 13*a* is restrained. Thereby, the inclination of the swash plate 5 as described above can be favorably supported by the first acting portion 134 and the second acting portion 135 while increase in size of the movable body 13*a*, increase in size of the compressor by extension is restrained.

Furthermore, in the compressor, the respective rear end sides of the first acting portion 134 and the second acting portion 135 are formed into the cylindrical shapes having the generating lines parallel with the pivoting axis M. Therefore, in the compressor, the first acting portion 134 and the second acting portion 135 are respectively in linear contact with the affected portion 5*f*. Thereby, in the compressor, contact pressure at the time of the first acting portion 134 and the second acting portion 135 pressing the swash plate 5 is reduced, and durability of the movable body 13*a* and the swash plate 5 is high.

In the above, the present invention is described based on the embodiment, but it goes without saying that the present invention is not limited to the above described embodiment, and can be applied by being properly changed within the range without departing from the gist of the present invention.

For example, the first acting portion 134 and the second acting portion 135 may be formed on the first cylinder portion 131 so that heights from the drive shaft axis O differ in the first acting portion 134 and the second acting portion 135 while the distance L1 from the first acting portion 134 to the top dead center surface F, and the distance L2 from the second acting portion 135 to the top dead center surface F are kept equal to each other.

Further, with respect to the affected portion 5*f*, the affected portion 5*f* may be formed into a shape that protrudes toward the first and the second acting portions 134 and 135 from the front surface 5*a* of the swash plate 5.

Furthermore, with respect to the control mechanism 15, the control mechanism 15 may have a structure in which the control valve 15*c* is provided in the high-pressure passage 15*b*, and the orifice 15*d* is provided in the low-pressure passage 15*a*. In this case, an opening degree of the high-pressure passage 15*b* is regulated by the control valve 15*c*, whereby the pressure of the control pressure chamber 13*b* can be quickly made high by the high pressure in the discharge chamber 35, and the discharge capacity can be quickly decreased.

The invention claimed is:

1. A variable displacement swash plate type compressor comprising:

a housing in which a suction chamber, a discharge chamber, a swash plate chamber and a cylinder bore are formed;

a drive shaft that is rotatably supported by the housing;

a swash plate rotatable in the swash plate chamber by rotation of the drive shaft;

a link mechanism that is provided between the drive shaft and the swash plate, and allows change of an inclination angle of the swash plate to a direction orthogonal to a drive shaft axis of the drive shaft;

a piston that is accommodated in the cylinder bore to be capable of reciprocating;

a conversion mechanism that causes the piston to reciprocate in the cylinder bore at a stroke corresponding to the inclination angle, by rotation of the swash plate;

an actuator capable of changing the inclination angle, and a control mechanism that controls the actuator, wherein the suction chamber and the swash plate chamber communicate with each other, the link mechanism has a lug member that is fixed to the drive shaft in the swash plate chamber, and faces the swash plate, and a swash plate arm through which rotation of the drive shaft is transmitted to the swash plate from the lug member, wherein the actuator includes the lug member, a movable body that is disposed between the lug member and the swash plate to engage with the swash plate to be integrally rotatable, and which moves in a direction of the drive shaft axis to be able to change the inclination angle, and a control pressure chamber that is defined by the lug member and the movable body and which moves the movable body by an internal pressure, wherein on the movable body, a first acting portion and a second acting portion that engage with the swash plate are formed, both the first acting portion and the second acting portion protrude from an axial end of the movable body in the direction of the drive shaft axis, wherein an affected portion that engages with the first acting portion and the second acting portion is an inclinable face of the swash plate, which is configured to incline with respect to the drive shaft axis when the inclination angle is changed, wherein both the first acting portion and the second acting portion oppositely face the affected portion in the direction of the drive shaft axis, wherein in the swash plate, a top dead center corresponding portion is defined as a portion corresponding to a top dead center of the piston, wherein the first acting portion, the second acting portion and the affected portion are located eccentrically to the top dead center corresponding portion, the first acting portion and the second acting portion are connected by a stepped surface, wherein the first acting portion and the second acting portion are arranged on opposing sides of a swash plate centerline passing through the drive shaft axis, and wherein both the first acting portion and the second acting portion face each other in a direction orthogonal to the drive shaft axis with the drive shaft interposed therebetween, and wherein the first acting portion and the second acting portion are separate from each other.

2. The variable displacement swash plate type compressor according to claim 1, wherein a distance from the first acting portion to a top dead center surface, which is formed extending from the top dead center corresponding portion of the swash plate to the drive shaft axis, and a distance from the second acting portion to the top dead center surface are substantially equal to each other.

3. The variable displacement swash plate type compressor according to claim 2, wherein the first acting portion and the second acting portion are plane-symmetrical with respect to the top dead center surface.

4. The variable displacement swash plate type compressor according to claim 1, wherein the swash plate is provided pivotably around a pivoting axis including a pivoting point that is located on an intersection line of an outer circumferential surface of the drive shaft and a top dead center surface, which is formed extending from the top dead center corresponding portion of the swash plate to the drive shaft axis, and the first acting portion and the second acting portion are formed into cylindrical shapes having generating lines parallel with the pivoting axis.

5. The variable displacement swash plate type compressor according to claim 1, wherein the inclinable face is planar.

* * * * *